US006319159B1

(12) United States Patent
Yu

(10) Patent No.: US 6,319,159 B1
(45) Date of Patent: Nov. 20, 2001

(54) GAME RACKET FRAME WITH WOODEN COVER LAYER

(76) Inventor: Kuo-Pin Yu, No. 6, Lane 477, Sec. 2, Feng-Shyn Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/711,090

(22) Filed: Nov. 14, 2000

(30) Foreign Application Priority Data

Oct. 13, 2000 (TW) ..... 89217757 U

(51) Int. Cl.[7] ..... A63B 49/02
(52) U.S. Cl. ..... 473/535
(58) Field of Search ..... 473/535, 536, 473/537

(56) References Cited

U.S. PATENT DOCUMENTS 4,098,505 * 7/1978 Thompson ..... 473/536
4,390,182 * 6/1983 You ..... 473/535
4,393,024 * 7/1983 You ..... 473/535 X
4,429,873 * 2/1984 Van Raemdonck ..... 473/536

FOREIGN PATENT DOCUMENTS

45991 * 2/1982 (EP) ..... 473/FOR 177
77134 * 4/1983 (EP) ..... 473/FOR 180
145820 * 6/1985 (EP) ..... 473/FOR 180
2495477 * 6/1982 (FR) ..... 473/FOR 180
2099311 * 12/1982 (GB) ..... 473/FOR 177

* cited by examiner

*Primary Examiner*—Raleigh W. Chiu
(74) *Attorney, Agent, or Firm*—Browdy and Neimark

(57) ABSTRACT

A game racket frame is formed of a main body and a wooden layer. The main body is formed of an annular head with string holes, a handle, and a neck connecting the head and the handle. The head and the neck are made of a plurality of fabric boards which are formed of fiber-reinforced plastic material and are wound together to have a receiving space in its interior. The wooden layer covers at least a portion of the main body to provide a shock-absorbing effect, a woody appearance, and a protection against static.

13 Claims, 5 Drawing Sheets

GAME RACKET FRAME WITH WOODEN COVER LAYER

FIELD OF THE INVENTION

The present invention relates generally to a game racket, and more particularly to a shock-absorbing frame of the game racket.

BACKGROUND OF THE INVENTION

The conventional game rackets, such as tennis racket, badminton racket, squash racket, etc., have a frame of aluminum alloy or fiber-reinforced plastic material. Such conventional racket frame is defective in design in that the shock wave is easily transmitted from the head to the handle, and that the appearance is rather monotonous at best, and further that the metal frame generates easily static.

SUMMARY OF THE INVENTION

It is the primary objective of the present invention to provide a game racket capable of absorbing shock.

It is another objective of the present invention to provide a game racket having a soothing appearance.

It is still another objective of the present invention to provide a game racket with means to prevent the game racket from generating static.

It keeping with the principle of the present invention, the foregoing objectives of the present invention are attained by a game racket comprising a main body and a wooden layer. The main body is formed of an oval head, a handle, and a neck connecting the head with the handle. The head and the neck are made of a plurality of fiber-reinforced plastic boards and are provided with a hollow interior. The main body is covered with the wooden layer which serves to give the main body an added shock-absorbing capability and wooden appearance. In addition, the wooden layer serves to prevent the main body from generating static.

DETAILED DESCRIPTION OF THE INVENTION

Figure 1:
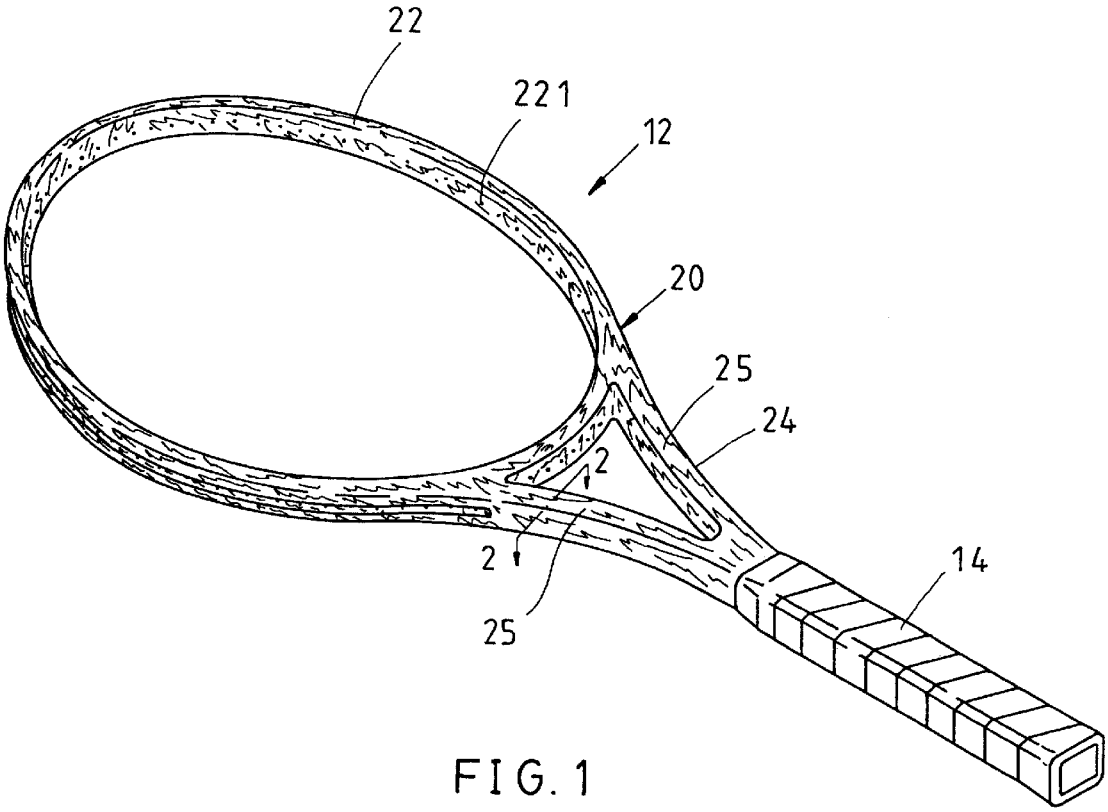
FIG. 1 shows a perspective view of a first preferred embodiment of the present invention.

As shown in FIG. 1, a game racket 12 of the present invention is formed of a frame 10 and a handle 14. The frame 10 is made up of a main body 20, a wooden layer 28, and a protective layer 29.

Figure 2:
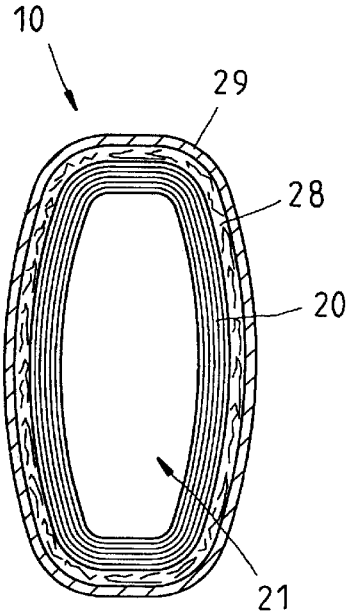
FIG. 2 shows a sectional view taken along the direction indicated by a line 2—2 as shown in FIG. 1.

The main body 20 has an oval head 22 and a neck 24 located between the head 22 and the handle 14. The head 22 is provided with a plurality of string holes 221 for holding strings which form a ball-hitting face. The neck 24 has two support rods 25 which are connected at one end with the head 22, and at other end with the handle 14. As shown in FIG. 2, the main body 20 is made of a plurality of fabric boards which are formed of a fiber-reinforced plastic material and are wound together. The main body 20 has a hollow interior 21. The main body 20 is made of a fiber-reinforced thermoplastic resin, or a fiber-reinforced thermosetting resin. The fiber is glass fiber, carbon fiber, boron fiber, or an aramid fiber, which is impregnated with epoxy resin.

The wooden layer 28 is used to cover the main body 20 in its entirety and is formed of a wood or bamboo. The wooden layer 28 gives the frame 10 a wooden appearance. The wooden layer 28 has a thickness ranging between 0.05 mm and 1.0 mm, preferably, 0.1 mm.

The protective layer 29 is intended to cover the wooden layer 28 and is made of a transparent or translucent fiber cloth or fiber-reinforced plastic material preimpregnated with epoxy resin. The protective layer 29 has dual purposes of protecting the wooden layer 28 and of exhibiting the wooden appearance of the wooden layer 28. The protective layer 29 is optional. In light of the main body 20 and the wooden layer 28 being different in density, their shock waves cancel out each other. As a result, the frame 10 of the present invention has an excellent shock-absorbing capability. In addition, the wooden layer 28 serves to give the frame 10 a woody appearance and to prevent the main body 20 from generating static.

Figure 3:
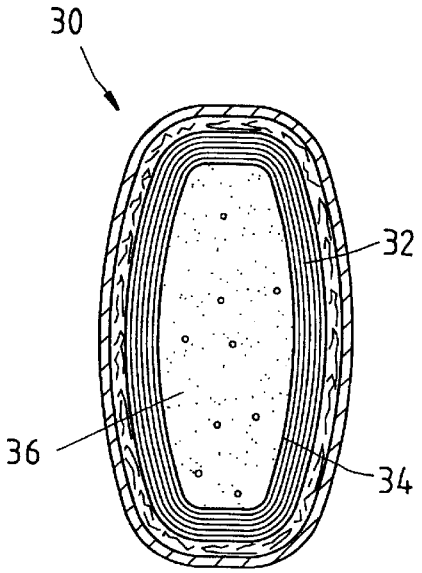
FIG. 3 shows a sectional view of a second preferred embodiment of the present invention.

As shown in FIG. 3, a game racket frame 30 of the second preferred embodiment of the present invention is basically similar in construction to the first preferred embodiment, except that the frame 30 has a main body 32 which is provided with a receiving space 34 in which a shock-absorbing body 36 is disposed. The shock-absorbing body 36 is made of a plastic foam material, such as PU.

Figure 4:
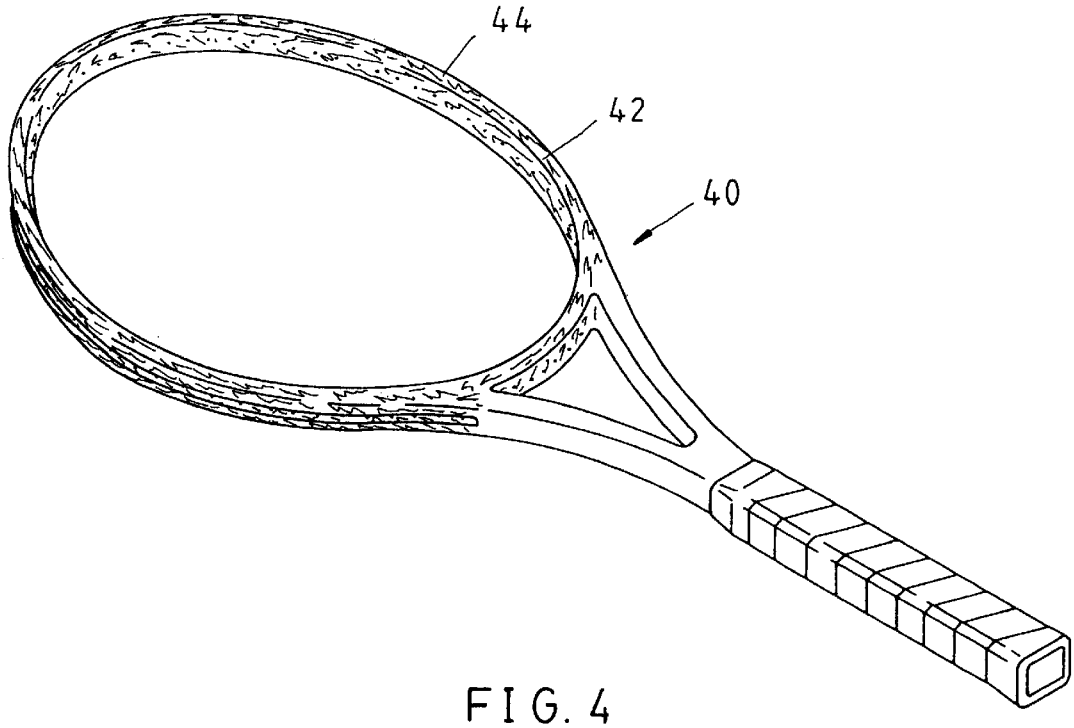
FIG. 4 shows a perspective view of a third preferred embodiment of the present invention.
Figure 5:
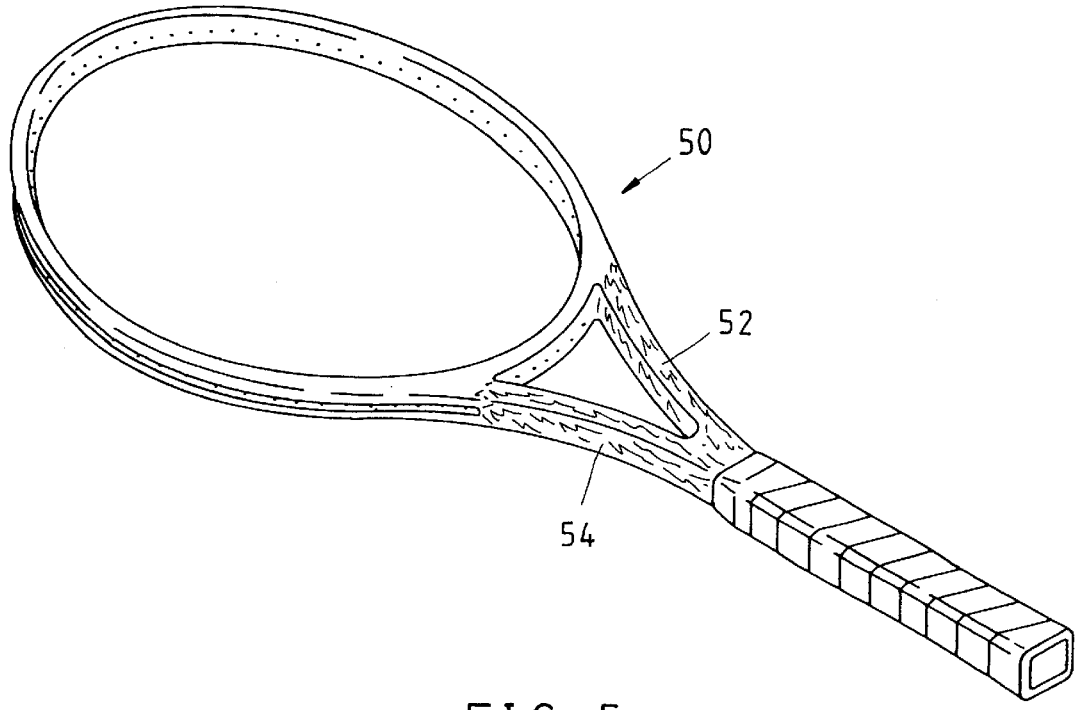
FIG. 5 shows a perspective view of a fourth preferred embodiment of the present invention.
Figure 6:
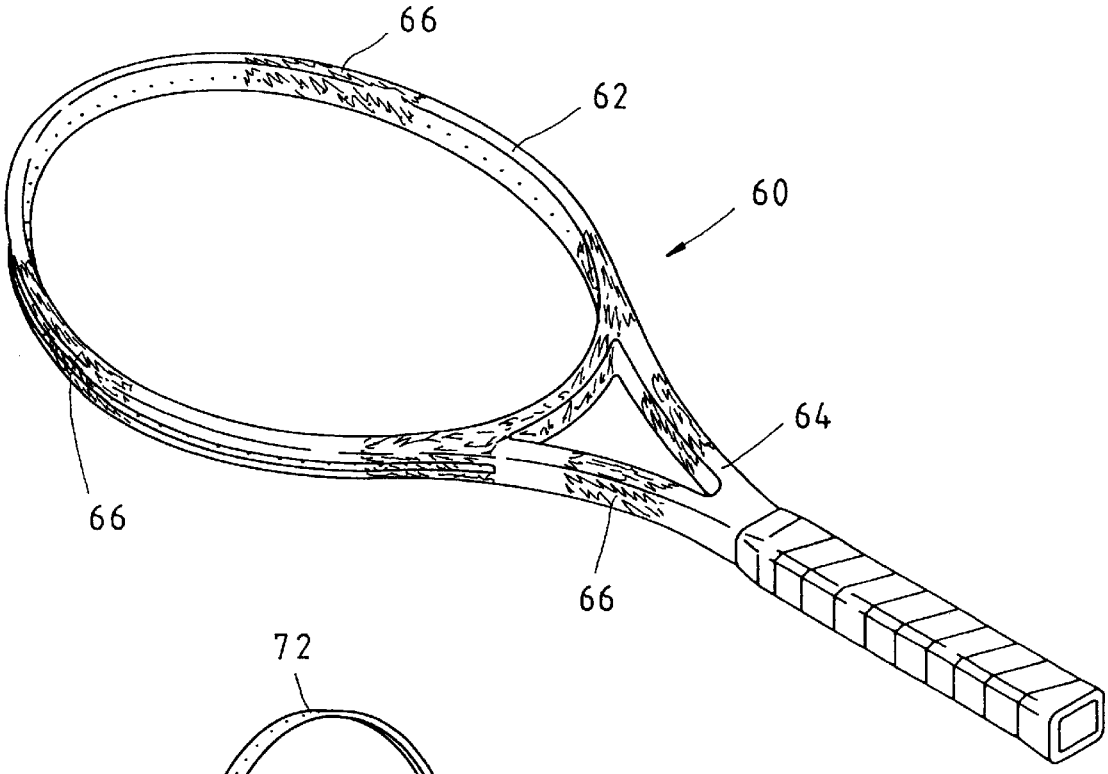
FIG. 6 shows a perspective view of a fifth preferred embodiment of the present invention.
Figure 7:
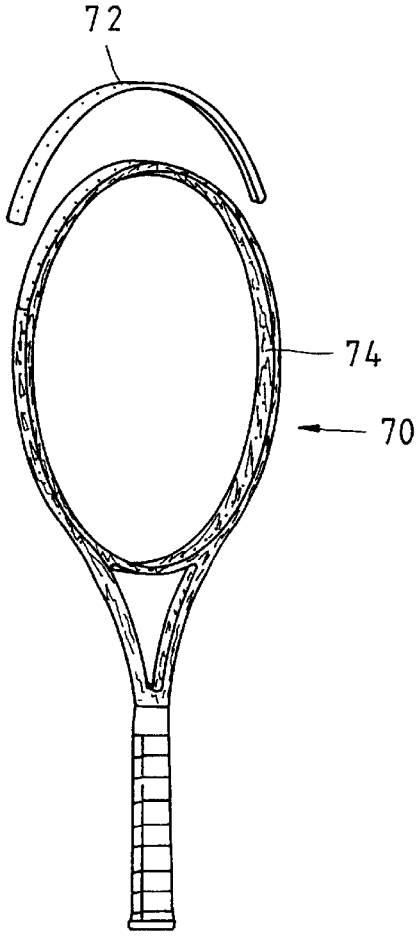
FIG. 7 shows a perspective view of a sixth preferred embodiment of the present invention.

As shown in FIG. 4, a wooden layer 44 of the present invention covers only the head 42 of the main body 40. As shown in FIG. 5, a wooden layer 54 of the present invention covers only the neck 52 of the main body 50. As shown in FIG. 6, a wooden layer 66 of the present invention is divided into five segments, which cover the head 62 and the neck 64 at an interval. As shown in FIG. 7, the main body 70 is covered with the wooden layer 74, with the exception of the protective strip 72.

Figure 8:
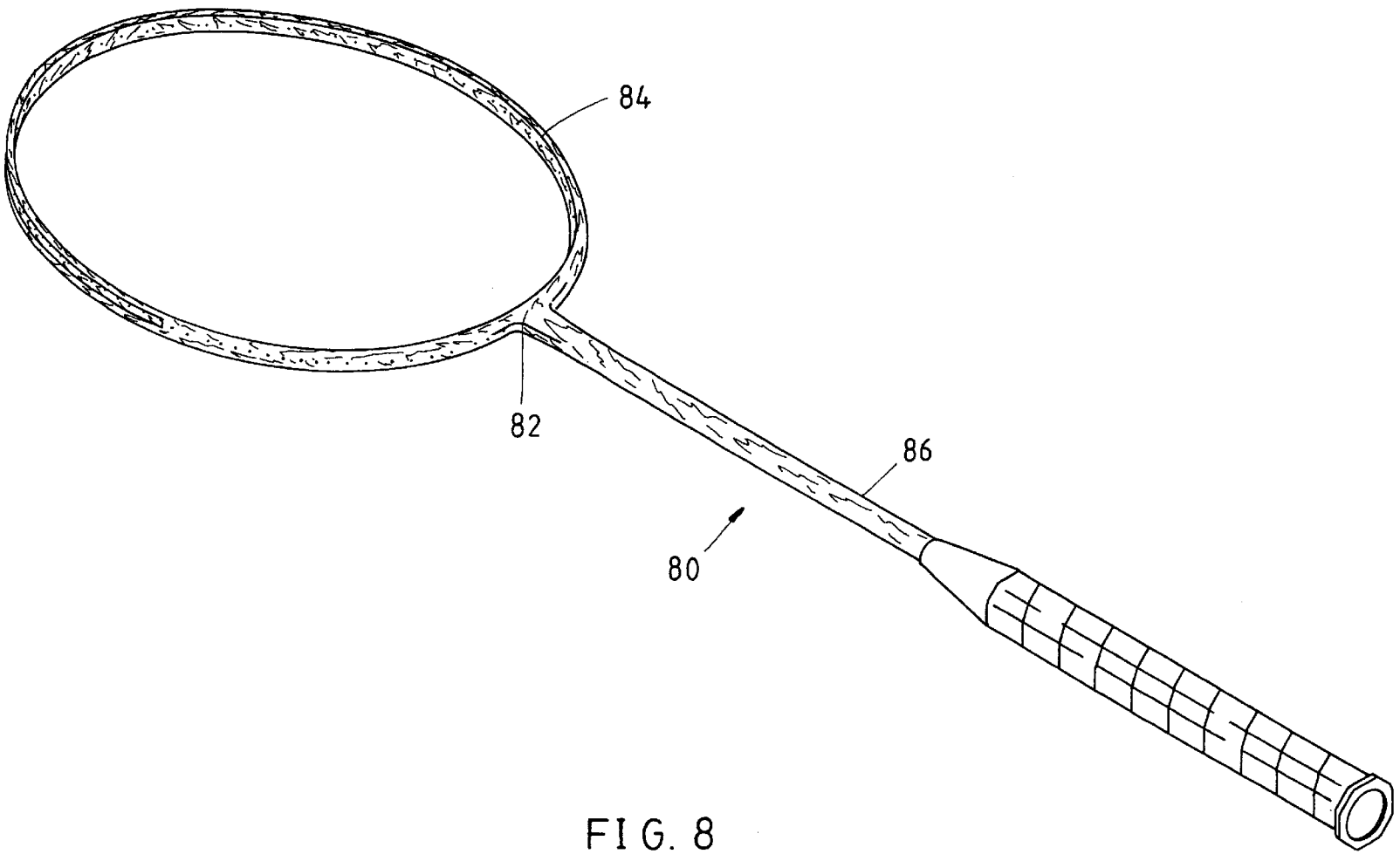
FIG. 8 shows a perspective view of a seventh preferred embodiment of the present invention.
Figure 9:
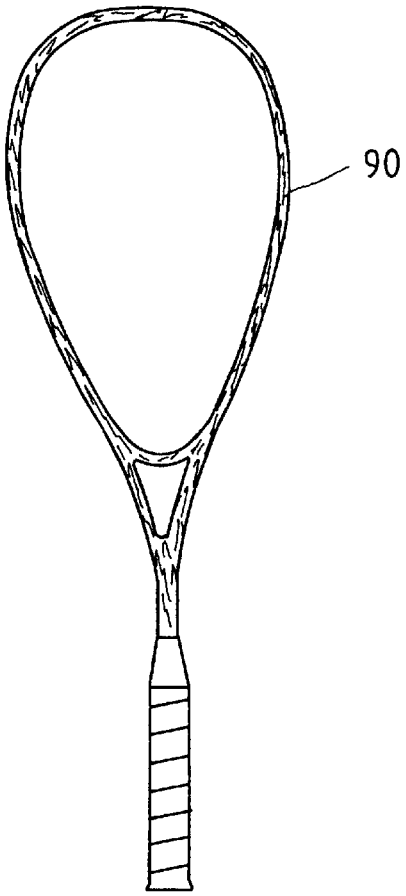
FIG. 9 shows a front view of an eighth preferred embodiment of the present invention.
Figure 10:
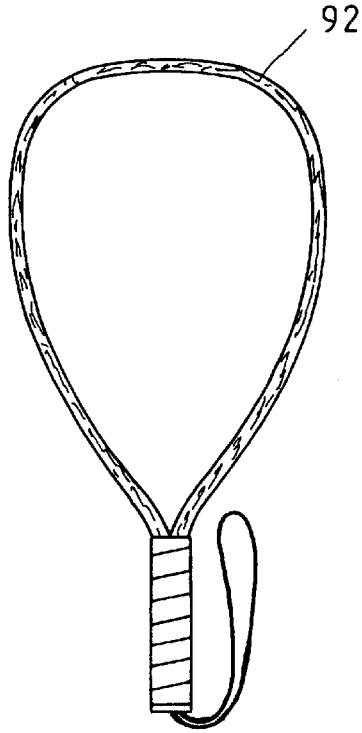
FIG. 10 shows a front view of a ninth preferred embodiment of the present invention.

As shown in FIG. 8, a badminton racket 80 comprises a head 84 and a handle 86. A paddle 90 and a squash racket 92 are shown respectively in FIG. 9 and FIG. 10. They are basically similar in construction to the tennis racket described above.

What is claimed is:

1. A game racket frame comprising:

a main body formed of a head, a handle, and a neck connecting said head and said handle, said head and said neck being made of a plurality of fabric boards which are formed of a fiber-reinforced plastic material and are wound together such that a receiving space is formed in an interior thereof; and a wooden layer covering a portion of said main body.

2. The game racket frame as defined in claim 1, wherein said receiving space is provided with a shock-absorbing body of a foam material.

3. The game racket frame as defined in claim 1, wherein said main body is made of a fiber-reinforced thermoplastic resin.

4. The game racket frame as defined in claim 1, wherein said main body is made of a fiber-reinforced thermosetting resin.

5. The game racket frame as defined in claim 1, wherein said main body is made of carbon fiber, glass fiber, boron fiber, or an aramid fiber, which is impregnated with resin.

6. The game racket frame as defined in claim 1, wherein said wooden layer has a thickness ranging between 0.05 mm and 1.0 mm.

7. The game racket frame as defined in claim 1, wherein said wooden layer covers said main body in its entirety.

8. The game racket as defined in claim 7, wherein said wooden layer has a thickness ranging between 0.05 mm and 1.0 mm.

9. The game racket as defined in claim 1 further comprising a transparent or translucent protective layer covering said main body and said wooden layer.

10. The game racket as defined in claim 9, wherein said protective layer is made of a fiber nonwoven cloth.

11. The game racket as defined in claim 9, wherein said protective layer is formed of a glass fiber reinforced plastic material.

12. The game racket as defined in claim 1, wherein said neck is straight.

13. The game racket as defined in claim 1, wherein said neck is formed of two support rods whereby said two support rods are connected at one end with said head, and fused at other end with said handle.

* * * * *